US009327498B1

(12) United States Patent
Mantell

(10) Patent No.: US 9,327,498 B1
(45) Date of Patent: May 3, 2016

(54) SYSTEM AND METHOD FOR APPLYING ELECTROMAGNETIC INK TO A NON-ELECTROMAGNETIC INK IMAGE

(71) Applicant: Xerox Corporation, Norwalk, CT (US)

(72) Inventor: David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/638,295

(22) Filed: Mar. 4, 2015

(51) Int. Cl.

| | |
|---|---|
| ***B41J 2/005*** | (2006.01) |
| ***B41J 2/01*** | (2006.01) |
| ***B41J 2/22*** | (2006.01) |
| ***B41J 2/485*** | (2006.01) |
| ***B41J 2/14*** | (2006.01) |

(52) U.S. Cl.
CPC ..... *B41J 2/14* (2013.01)

(58) Field of Classification Search
CPC ..... B41J 2/14
USPC ..... 347/9, 103
See application file for complete search history.

(56) References Cited

U.S. PATENT DOCUMENTS

| | | | | |
|---|---|---|---|---|
| 4,901,114 | A | 2/1990 | Parker et al. | |
| 5,347,302 | A | 9/1994 | Simonoff | |
| 6,195,453 | B1 | 2/2001 | Simonoff | |
| 6,909,856 | B2 | 6/2005 | Crichton | |
| 7,789,504 | B2 * | 9/2010 | Tombs | B41J 2/0057 347/103 |
| 8,131,163 | B2 | 3/2012 | Matsui et al. | |
| 8,617,776 | B2 | 12/2013 | Morgan et al. | |
| 2005/0095016 | A1 | 5/2005 | Simpson et al. | |
| 2005/0207635 | A1 | 9/2005 | Lazar et al. | |
| 2006/0061642 | A1 * | 3/2006 | Ueki | B41J 11/0015 347/101 |
| 2006/0203026 | A1 * | 9/2006 | Inoue | B41J 2/175 347/16 |
| 2006/0221166 | A1 * | 10/2006 | Inoue | B41J 13/02 347/104 |
| 2012/0103221 | A1 * | 5/2012 | Stowe | B41C 1/1033 101/483 |

* cited by examiner

*Primary Examiner* — Stephen Meier
*Assistant Examiner* — Alexander D Shenderov
(74) *Attorney, Agent, or Firm* — Maginot Moore & Beck LLP

(57) ABSTRACT

A digital printer is configured to form with marking material a solid background and a negative image of features to be formed with a liquid ink. The liquid ink is applied to the solid background and negative image of the features to be formed with the liquid ink with an applicator that contacts the surface on which the solid background and features are located. An absorbent member is moved into contact with the solid background and the features formed with the liquid ink to remove the liquid ink from the solid background, while leaving the liquid ink in the features.

8 Claims, 4 Drawing Sheets

SYSTEM AND METHOD FOR APPLYING ELECTROMAGNETIC INK TO A NON-ELECTROMAGNETIC INK IMAGE

TECHNICAL FIELD

This disclosure relates generally to inkjet printers, and more particularly to inkjet printers that produce ink images with electromagnetic ink.

BACKGROUND

In general, inkjet printers include at least one printhead that ejects drops of liquid ink onto a surface of an image receiving member. In an indirect or offset printer, the inkjets eject ink onto the surface of a rotating image receiving member, such as a rotating metal drum or endless belt, before the ink image is transferred to print media. In a direct printer, the inkjets eject ink directly onto print media, which may be in sheet or continuous web form. A phase change inkjet printer employs phase change inks that are solid at ambient temperature, but transition to a liquid phase at an elevated temperature. Once the melted ink is ejected onto the media or image receiving member, depending upon the type of printer, the ink droplets quickly solidify to form an ink image.

Inkjet printers are used to print a wide range of documents using various types and colors of ink. Some printed documents are read by both humans and machines. For example, a check includes printed text that is both human readable and readable by automated check processing equipment. Check processing machines use Magnetic Ink Character Recognition (MICR) to identify printed characters in a check, such as routing and account numbers, quickly and accurately. The magnetic ink readable by MICR machines includes a suspension of magnetic particles, such as iron oxide, which are detectable using a magnetic field. The use of MICR printing is widespread and enables automated processing of checks and other documents. Automated check processing machines perform high-speed character recognition using printed magnetic ink characters to identify account and routing numbers. While check processing is one application of magnetic ink printing, magnetic inks can be incorporated in a wide range of printed documents and can be used in conjunction with non-electromagnetic inks as well.

Printing with magnetic inks can be difficult, particularly in printing systems that use printheads having inkjets. In many cases, the ink supplied to a printhead that ejects magnetic ink is held in an internal reservoir. If an image that includes features to be printed with magnetic ink is printed with irregularity, the magnetic particles in the ink in the reservoir or other channels within the printhead can settle out of the ink. This settling makes getting enough magnetically active particles into the ink and eventually into the printed image troublesome. Additionally, media surface preparation or the fusing or spreading of other ink types on the media can interfere with the magnetic ink properly bonding to the media. Making magnetic ink printing in inkjet printing systems more efficient would be advantageous.

SUMMARY

In one embodiment a method of printing enables features to be formed with electromagnetic ink in images printed by an inkjet printing system without requiring the electromagnetic ink to be applied with an inkjet printhead. The method includes operating at least one marking material applicator with a controller with reference to image data to form an image with a non-electromagnetic marking material, the non-electromagnetic marking material forming a solid background area and a negative image of features to be formed with an electromagnetic ink, operating an actuator with the controller to move a member into contact with a substrate that received the image to apply the electromagnetic ink to the solid background area and the negative image of the features to be formed with the electromagnetic ink, and removing the electromagnetic ink from the solid background area on the substrate.

A digital inkjet printer enables features to be formed with electromagnetic ink in images printed by the inkjet printer system without requiring the electromagnetic ink to be applied to the image with an inkjet printhead. The printer includes at least one printhead configured to eject non-electromagnetic ink onto an image receiving surface as the image receiving surface passes the at least one printhead in a process direction, an actuator operatively connected to a member, the actuator being configured to move the member into contact with the image receiving surface to apply electromagnetic ink to the solid background area and the negative image of the features to be formed with electromagnetic ink, an actuator operatively connected to an absorbent member, the actuator being configured to move the absorbent member into and out of contact with the image receiving surface to remove electromagnetic ink from the solid background area, and a controller that is operatively connected to the actuators and the at least one marking material applicator. The controller is configured to operate the at least one printhead with reference to image data to apply non-electromagnetic ink to form on the image receiving surface a solid background area and a negative image of features to be formed with electromagnetic marking material, operate the actuator operatively connected to the member to apply electromagnetic ink to the solid background area and the negative image of features to be formed with electromagnetic ink, and operate the actuator operatively connected to the absorbent member to remove electromagnetic ink from the solid background area.

An indirect digital inkjet printer enables features to be formed with electromagnetic ink in images printed by the inkjet printer system without requiring the electromagnetic ink to be applied to the image with an inkjet printhead. The printer includes an imaging member, at least one marking material applicator configured to eject non-electromagnetic ink onto a surface of the imaging member as the imaging member rotates past the at least one printhead in a process direction, an actuator operatively connected to a roller, the actuator being configured to move the roller into and out of engagement with the imaging member to form selectively a nip between the roller and the imaging member, a media transport to move a media sheet into the nip formed between the imaging member and the roller to transfer the non-electromagnetic ink from the surface of the imaging member to the media, another actuator operatively connected to a member, the actuator operatively connected to the member being configured to move the member into engagement with the media, another actuator operatively connected to an absorbent member, the actuator operatively connected to the absorbent member being configured to move the absorbent member into engagement with the media, and a controller that is operatively connected to the actuators and the at least one printhead. The controller is configured to operate the at least one marking material applicator with reference to image data to apply non-electromagnetic marking material to form on the surface of the imaging member a solid background area and a negative image of features to be formed with electromagnetic ink, operate the actuator operatively connected to the roller to form the nip and enable media to pass through the nip to transfer non-electromagnetic marking material from the surface of the imaging member to the media, operate the actuator operatively connected to the member to apply electromagnetic ink to the solid background area and a negative image of features to be formed with electromagnetic ink, and operate the actuator operatively connected to the absorbent member to remove electromagnetic ink from the solid background area.

DETAILED DESCRIPTION

Figure 1:
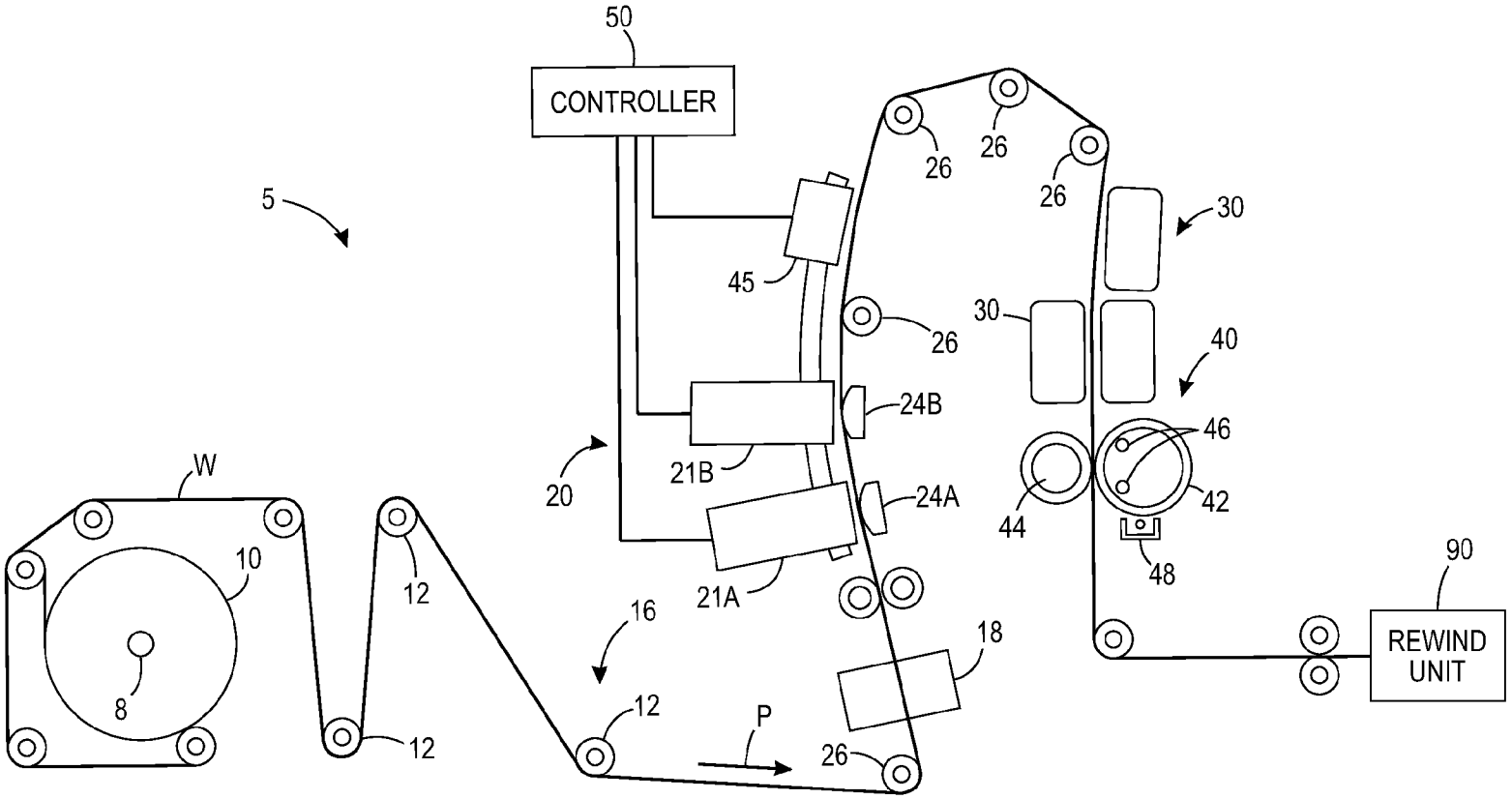
FIG. 1 is a schematic depiction of a direct-to-media inkjet printer that forms image features with electromagnetic ink without ejecting the ink from an inkjet printhead.

For a general understanding of the environment for the system and method disclosed herein as well as the details for the system and method, reference is made to the drawings. In the drawings, like reference numerals have been used throughout to designate like elements.

As used herein the term "printer" refers to any digital device that is configured to produce variable images made by depositing one or more marking materials or colorants on print media. Common examples of printers include, but are not limited to, xerographic and inkjet printers, which includes three-dimensional object inkjet printers. Various printer embodiments use one or more marking materials, such as ink or toner, to form printed images in various patterns. An image receiving surface refers to any surface that receives a marking material, such as an imaging drum, imaging belt, a platen for receiving three-dimensional object forming materials, or various print media including paper. As used herein, the term "non-electromagnetic marking material" refers to a substance lacking an atypical electromagnetic, mechanical, chemical, or optical material that is deposited on a surface for the production of a printed image on a substrate. The non-electromagnetic marking material can be xerographic developer, toner particles or liquid ink. Known inks useful for printing documents having electromagnetic features include, for example, UV curable, oxidative, and laser inks. The term "substrate" refers to a print medium, such as paper, that holds printed images. The printer described in this document is a digital printer. As used in this document, "digital printer" means a printer that generates or receives electronic image data that enables the image to be printed to be modified or otherwise adjusted prior to the image being produced on the substrate. As used in this document, the term "electromagnetic ink" refers to an ink having a composition that includes an atypical electromagnetic, mechanical, chemical or optical material to be applied to the negative image of features to be printed with the ink. For example, electromagnetic ink can be composed of a suspension of electromagnetic particles in a liquid. Some electromagnetic inks include a suspension of particles, such as iron oxide, in an aqueous or organic based solvent. Other electromagnetic inks include conductive inks, inks with chemicals that impart various degrees of hardness, inks that impart optical properties, such as reflective surfaces, and the like.

MICR, as used in this document, refers to a process for printing documents in which magnetic features are formed with magnetic inks and the magnetic features are printed with special fonts to produce machine readable information that facilitates document processing. The fonts and other special parameters used to print documents having magnetic features are defined by a variety of standards. These standards include, but are not limited to, standards published in the United States by the American National Standards Institute (ANSI) and the American Bankers Association, or international standards, such as, ISO 1004-1995, which is published by the International Standards Organization, or those published by the Australian Bankers Association or the Association for Payment Clearing Service in the United Kingdom. The non-electromagnetic ink and electromagnetic ink are characterized by significant contrast in the electromagnetic properties of the respective inks, which in the case of MICR is the magnetization of the MICR pattern. The negative pattern filled by the electromagnetic material in this case demonstrates contrast because the features printed with the electromagnetic material exhibit magnetic properties, which enable the MICR reading process to detect the magnetic pattern, while the background printed with the non-electromagnetic marking material does not exhibit magnetic properties.

A continuous feed or "web" printer produces images on a continuous web print substrate such as paper. In some configurations, continuous feed printers receive image substrate material from large, heavy rolls of paper that move through the printer continuously instead of as individually cut sheets. The paper rolls can typically be provided at a lower cost per printed page than pre-cut sheets. Each such roll provides an elongated supply of paper printing substrate in a defined width. Fan-fold or computer form web substrates may be used in some printers having feeders that engage sprocket holes in the edges of the substrate. After formation of the images on the media web, one or more cutting devices separate the web into individual sheets of various sizes. Some embodiments use continuous feed printing systems to print a large number of images in a timely and cost efficient manner.

FIG. 1 is a simplified schematic view of the direct-to-sheet, continuous-media, phase-change inkjet printer 5, that is configured to print images using both magnetic and non-electromagnetic inks. A media supply and handling system is configured to supply a long (i.e., substantially continuous) web of media 14 of "substrate" (paper, plastic, or other printable material) from a media source, such as spool of media 10 mounted on a web roller 8. One common type of substrate is uncoated paper. The uncoated paper includes a matrix of cellulose fibers. The uncoated paper is porous and can absorb liquids, including liquid inks, which are printed on the paper. The printer 5 includes a feed roller 8, media conditioner 16, printing station or print zone 20, and rewind unit 90. The media source 10 has a width that substantially covers the width of the rollers 12 and 26 over which the media travels through the printer. The rewind unit 90 is configured to wind the web onto a take-up roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a print zone 20 that includes a series of printhead units 21A and 21B. Each printhead unit effectively extends across the width of the media and is able to place ink directly (i.e., without use of an intermediate or offset member) onto the moving media. Each of the printhead units 21A and 21B includes a plurality of printheads positioned in a staggered arrangement in the cross-process direction over the media web 14. As is generally known, each of the printheads can eject a single color of ink, one for each of the inks typically used in the printer 5.

Each of the printhead units in the printer 5 can use "phase-change ink," by which is meant that the ink is substantially solid at room temperature and substantially liquid when heated to a phase change ink melting temperature for jetting onto the image receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink is typically heated before being ejected by the inkjets of the printhead. As used herein, "liquid ink" refers to melted solid ink, heated gel ink, or other known forms of ink, such as aqueous inks, ink emulsions, ink suspensions, ink solutions, or the like.

In the configuration illustrated in FIG. 1, the printhead units 21A and 21B eject non-electromagnetic ink onto the media web 14. These printhead units can include multiple printheads arranged in staggered arrays that eject different colors of non-electromagnetic ink for multi-color printing. In the print zone 20, the media web 14 passes the printhead units 21A and 21B in the process direction P to receive non-electromagnetic ink prior to passing the electromagnetic ink applicator 45 to receive electromagnetic ink.

The controller 50 of the printer receives velocity data from encoders mounted proximate to rollers positioned on either side of the portion of the path opposite the printhead units 21A and 21B to compute the position of the web as the web moves past the printheads. The controller 50 uses these data to generate timing signals for actuating the inkjets in the printheads to enable the different colors ejected by the printheads in the printhead units to be ejected with a reliable degree of accuracy for registration of the non-electromagnetic ink patterns to form single or multi-color images on the media. The controller 50 generates the firing signals with reference to image data corresponding to the image to be printed. The image data can be transmitted to the printer, generated by a scanner (not shown) that is a component of the printer, or otherwise electronically or optically generated and delivered to the printer. In various alternative embodiments, the printer 5 includes a different number of printhead units and can print inks having a variety of different colors.

A backing member 24A, 24B, and 24C is associated with each of printhead units 21A and 21B and the electromagnetic ink applicator 45, respectively. The backing members 24A, 24B, and 24C are typically in the form of a bar or roll, which is arranged substantially opposite the printhead or applicator on the back side of the media. Each backing member is used to position the media at a predetermined distance from the printhead or applicator opposite the backing member. Each backing member can be configured to emit thermal energy to heat the media to a predetermined temperature. In one practical embodiment, the backing member emits thermal energy in a range of about 40° C. to about 60° C. The backer members can be controlled individually or collectively. The pre-heater 18, the printheads, backing members 24 (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads and applicator of the print zone 20, the printer 5 maintains the temperature of the media web 14 within a predetermined temperature range. The printheads in the printhead unit 21A eject a phase-change ink at a temperature that is typically significantly higher than the temperature of the media web 14. Consequently, the ink heats the media. Therefore, other temperature regulating devices can be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Figure 2:
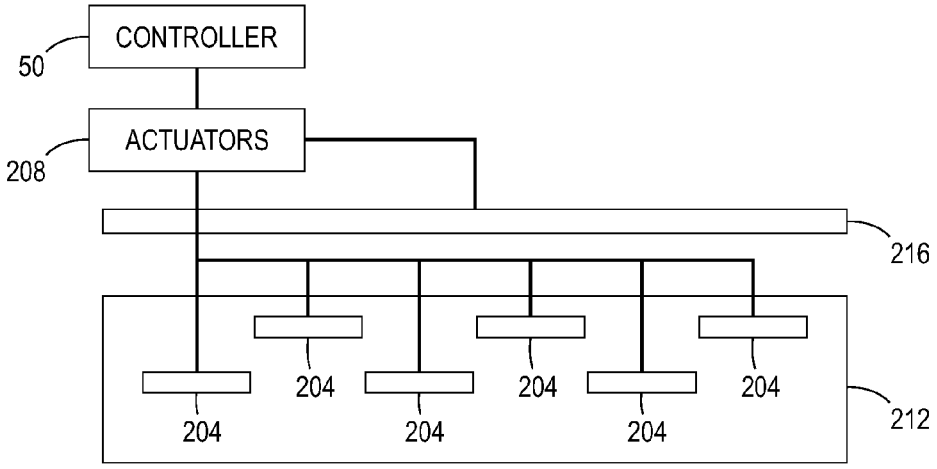
FIG. 2 is a schematic depiction of a electromagnetic ink applicator used in the printer of FIG. 1.

Following the print zone 20 along the media path, the media web 14 moves past a electromagnetic ink applicator 45. In one embodiment, the electromagnetic ink applicator 45 is an array of movable members, such as rollers 204 shown in FIG. 2 or pads as described below. Each of the rollers is operatively connected to an actuator in a plurality of actuators 208 in a one-to-one correspondence and each actuator is operatively connected to the controller 50. The controller 50 selectively activates and deactivates the actuators 208 to move a roller into and out of engagement with the web W as the web passes the applicator 45. The movement of any roller is independent of the other rollers in the array of rollers. The movement of the rollers is into and out of the plane of the figure. When the rollers 204 are out of engagement with the web, they contact an absorbent layer 212 that holds electromagnetic ink and the actuators can be configured to rotate the rollers against the layer to apply electromagnetic ink to the surface of the rollers. In response to an actuator being activated by the controller 50, the roller engages the web and rotates as the web passes by the roller. This action transfers electromagnetic ink from the roller to the web. In an alternative embodiment, the rollers 204 can include an internal reservoir of electromagnetic ink that is configured to enable ink to seep from the reservoir to the outer layer of the roller. In another alternative embodiment, the rollers 204 can be implemented with planar pads backed by another absorbent member containing electromagnetic ink that operates as a stamp pad to replenish the electromagnetic ink in the stamps. The electromagnetic ink applicator 45 is positioned on the same side of the media web 14 as the printhead units 21A and 21B.

Thus, the electromagnetic ink applicator applies electromagnetic ink to the ink image printed on the media web 14. An absorbent member 216 is operatively connected to an actuator 208. The controller 50 is operatively connected to this actuator 208 to move the absorbent member 216 into contact with the media to absorb electromagnetic ink resting on a solid background area printed with a non-electromagnetic ink as explained further below.

Following the print zone 140 along the media path, the media web moves over guide rollers 26 to one or more "mid-heaters" 30. A mid-heater 30 can use contact, radiant, conductive, and/or convective heat to control a temperature of the media. The mid-heater 30 brings the phase-change ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print).

Following the mid-heaters 30, a fixing assembly 40 is configured to apply heat and/or pressure to the media to fix the images to the media. The fixing assembly 40 includes any suitable device or apparatus for fixing images to the media including heated or unheated pressure rollers, radiant heaters, heat lamps, and the like. In the embodiment of FIG. 1, the fixing assembly includes image-side roller 42 and pressure roller 44. These rollers apply a predetermined pressure, and in some implementations, heat, to the media web. The function of the fixing assembly 40 is to take droplets, strings of droplets, or lines of ink on the web and smear the ink by pressure and, in some systems, heat, so that spaces between adjacent drops are filled and image solids become uniform. In addition to spreading the ink, the fixing assembly 40 also improves image permanence by increasing ink layer cohesion and/or increasing the ink-web adhesion. Either roller can include heat elements, such as heating elements 46, to bring the web to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like.

In one practical embodiment, the roller temperature in the fixing assembly 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi/side. Lower nip pressure gives less line spread while higher pressure may increase wear on the pressure roller.

The fixing assembly 40 also includes a cleaning/oiling station 48 associated with the image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one embodiment, the mid-heater 30 and fixing assembly 40 can be combined into a single unit, with their respective functions occurring relative to the same portion of media simultaneously. In another embodiment the media is maintained at a high temperature as it is printed to enable spreading of the ink.

Following passage through the media path, the printed media can be wound onto a roller for removal from the system. A rewind unit 90 winds the printed media web onto a take-up roller for removal from the printer 5 and subsequent processing. Alternatively, the media can be directed to other processing stations that perform tasks such as cutting, binding, collating, and/or stapling the media or the like.

Operation and control of the various subsystems, components and functions of the printer 5 are performed with the aid of the controller 50. The controller 50 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The inks ejected by the printheads in the printhead units 21A and 21B repel the electromagnetic ink applied by the applicator 45. That is, the inks ejected by the printheads form a barrier between electromagnetic ink and the underlying media that prevents the media from absorbing the electromagnetic ink. Therefore, by printing with non-electromagnetic marking material a solid background area and a negative image of the magnetic features in the area to which the electromagnetic ink is applied, the electromagnetic ink adheres to the media to form the electromagnetic features. As used in this document, "electromagnetic features" refers to alphanumeric characters, graphical characters, and symbols as defined by a standard, such as one of the MICR standards, that are printed with electromagnetic ink to provide the features with an atypical electromagnetic or optical property. Also, as used in this document, "negative image" refers to an outline of electromagnetic features formed with non-electromagnetic marking material and "solid background area" refers to the area in which the negative image is formed receiving an amount of non-electromagnetic marking material that prevents electromagnetic ink applied to the area from adhering to the underlying media in a visually discernible manner. An area printed as a solid background area need not be formed with a single color, that is, a "solid color." Accordingly, a solid background area can be formed with multiple colors of non-electromagnetic marking material.

Figure 3:
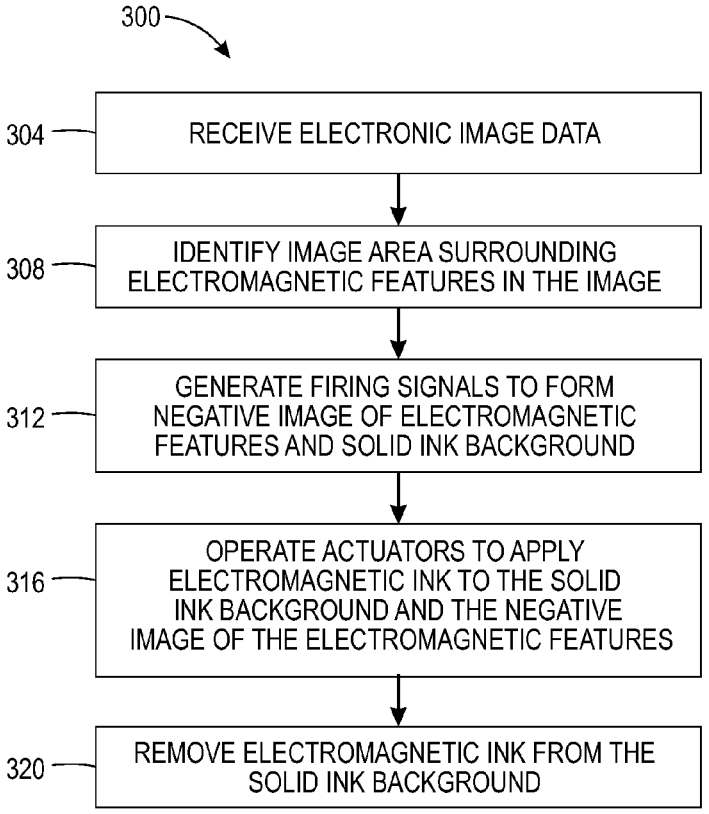
FIG. 3 is a block diagram of a process for printing images with features formed with electromagnetic ink without ejecting the ink from an inkjet printhead.

FIG. 3 depicts a process 300 for operating the printer 5 to form the negative magnetic feature images with the non-electromagnetic inks and then apply the electromagnetic ink to those areas printed in that manner. The process 300 is described in conjunction with the printer 5 of FIG. 1 for illustrative purposes. While process 300 is described with reference to the continuous media printer 5, other printing devices, including cut-sheet media printers, such as the one described below, can be configured to operate and perform the process 300. The process 300 refers to a controller, such as the controller 50 described above, executing programmed instructions stored in a memory operatively connected to the controller to cause the controller to operate one or more components of the printer to perform the specified function or action described in the process.

Figure 4A:
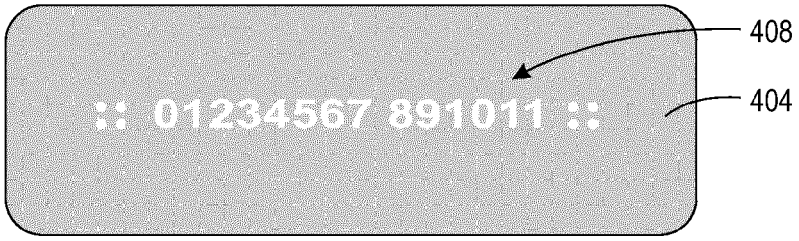
FIG. 4A depicts a negative image of magnetic features and a solid background area formed with non-electromagnetic ink.
Figure 4B:
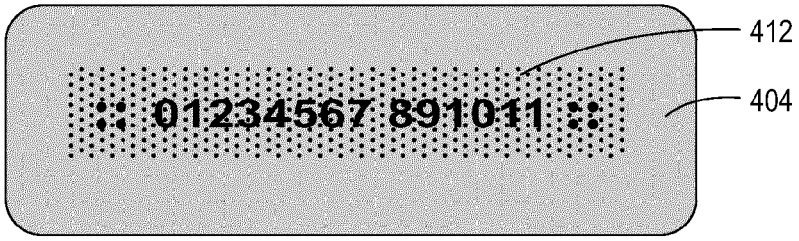
FIG. 4B depicts electromagnetic ink being applied to the negative image of magnetic features and the solid background of FIG. 4A.
Figure 4C:
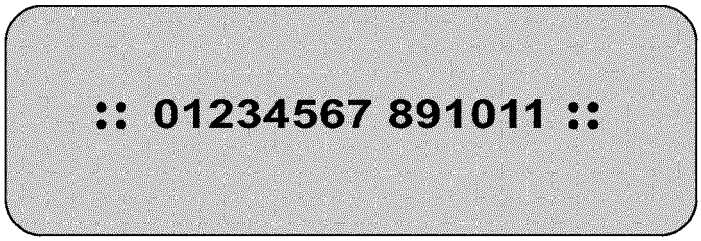
FIG. 4C depicts the solid background area and the electromagnetic ink within the negative image of the magnetic features after the electromagnetic ink is removed from the solid background area of FIG. 4B.

In the process 300, the controller receives electronic image data corresponding to an image to be printed (block 304). The electronic image data can be received from a computer or other electronic device operatively connected to the printer, from a scanner that is a component of the printer, or otherwise electronically or optically generated and delivered to the controller. The electronic image data includes a number of non-electromagnetic pixels and a number of electromagnetic ink pixels. The controller then identifies an area surrounding the positions where the electromagnetic ink pixels are to be ejected (block 308). The controller then generates firing signals for the inkjet ejectors with reference to the image data that print the identified area to form a solid background area and a negative image of the electromagnetic features (block 312). During the generation of the firing signals, the controller can adjust the negative image of the electromagnetic features to compensate for errors that can occur during printing. For example, the pixels of the solid background area may encroach into the area of the electromagnetic features, the media may shrink during its printing, or the electromagnetic ink may be absorbed into the media underlying a portion of the solid background area. These types of errors can be compensated by, for example, adjusting the font used to represent the electromagnetic features. This compensation enables the negative image of the electromagnetic features to be formed so the printed electromagnetic features accurately represent the expected dimensions of the features defined by an applicable standard, such as one of the MICR standards. An example of a solid background area 404 and a negative image of magnetic features 408 composed of a set of characters to be printed in electromagnetic ink is shown in FIG. 4A. This solid background area 404 is printed with a marking material having a color that contrasts well with the electromagnetic ink. Typically, electromagnetic ink is black or some other dark color so the solid background area is printed with a light color, such as yellow, or clear marking material depending upon the color of the media. Of course, other colors can be used if the electromagnetic ink has a color other than black or some other dark color provided the colors meet the requirements of the applicable standard for the background of the magnetic features. Contrast also includes and can primarily be in the desired electromagnetic property of the pattern produced with the electromagnetic ink rather than the color. As the printed image approaches the electromagnetic ink applicator 45, the controller 50 operates the actuators that move the members, such as the rollers or pads, to engage the media at the areas corresponding to the electromagnetic features (block 316) and to disengage the media before the end of the printed area is reached. As the electromagnetic ink is applied by one or more rollers to the media, the electromagnetic ink rests upon the solid background area, but adheres to the media in the negative image. An example of the application of the electromagnetic ink 412 is shown in FIG. 4B. Thus, the electromagnetic features are formed with the electromagnetic ink. An absorbent wiper is then applied to the media to remove the electromagnetic ink from the solid background area (block 320). An example of the finished image area is shown in FIG. 4C. The web then continues through the printer to be processed as previously described.

Figure 5:
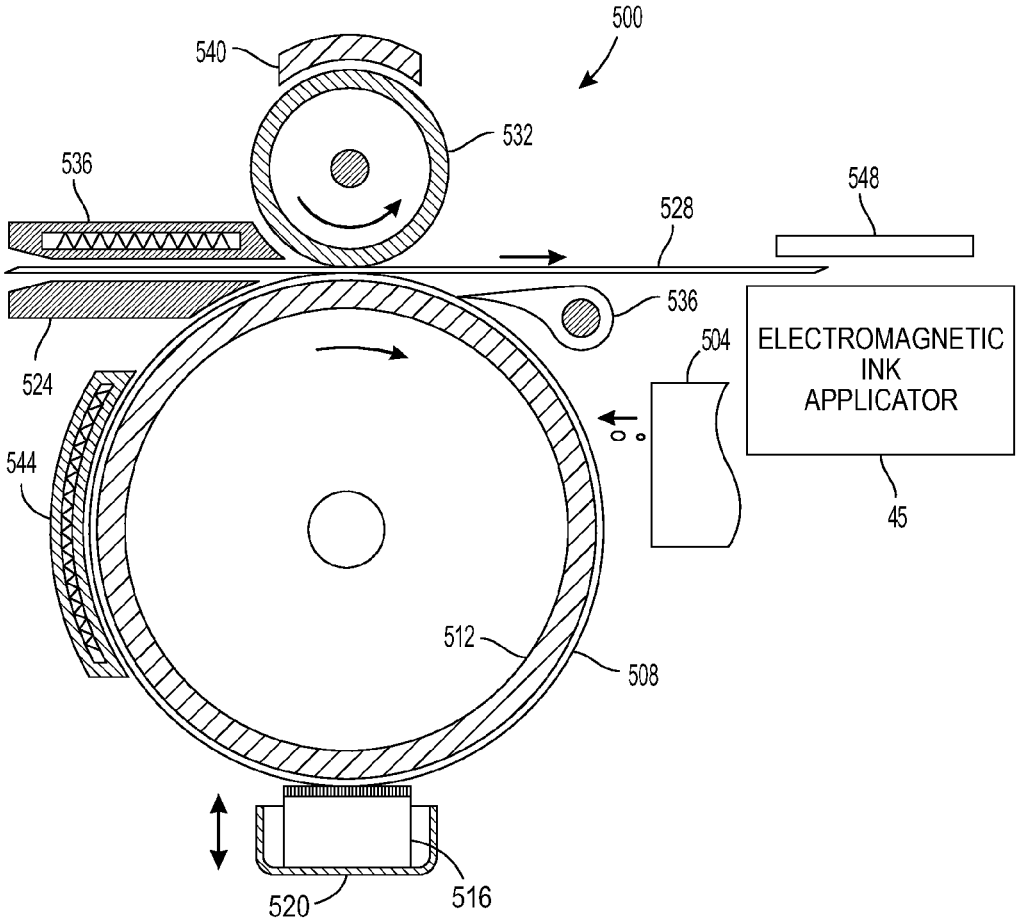
FIG. 5 is a schematic depiction of an indirect inkjet printer that forms image features with electromagnetic ink without ejecting the ink from an inkjet printhead.

FIG. 5 depicts an illustration of an indirect printer 500 that uses the method of FIG. 3 to form electromagnetic features. A printhead 504 ejects non-electromagnetic ink on the intermediate transfer surface 508 of imaging member 512. A controller operates as previously described to identify an area in which electromagnetic features are formed and operates the inkjets in the printhead 504 to form the solid background area and negative mirror image of the electromagnetic features. Intermediate transfer surface 508 is a liquid layer that is applied to the supporting surface of the imaging member 512, which is shown as a drum, but may also be a platen, an endless belt, or any other suitable design. In printer 500, the liquid layer is applied by the wicking pad 516 contained within applicator assembly 520. The drum 512 can be formed from any appropriate material, such as metals including but not limited to aluminum, nickel or iron phosphate. Applicator assembly 520 is mounted for retractable movement upward into contact with the surface of drum 512 and downwardly out of contact with the surface of the drum 512 and its liquid layer 508 by means of appropriate mechanism, such as an air cylinder or an electrically actuated solenoid. A substrate guide 524 passes an image receiving substrate 528, such as paper, from a positive feed device (not shown) and guides it through the nip formed by the opposing arcuate surfaces of the roller 532 and the intermediate transfer surface 508 supported by the drum 512. Stripper fingers 536 (only one of which is shown) can be pivotally mounted to the printer 500 to assist in removing any paper or other image receiving substrate media from the exposed surface of the liquid layer forming the intermediate transfer surface 508. Roller 532 has an elastomeric covering that engages the image receiving substrate 528 on the reverse side of the substrate. The pressure within the nip fuses or fixes the ink image to the surface of the image receiving surface so that the ink image is spread, flattened and adhered. Heaters 536, 540, and 544 can be provided to heat, respectively, the substrate 528, the roller 532, and the ink image on the surface 508.

An electromagnetic ink applicator 45 is positioned to enable a controller to activate selectively actuators so members, such as rollers or pads, engage the media and apply electromagnetic ink to the area(s) in which negative image(s) of magnetic features have been formed. A platen 548, or other backing member, is provided on the reverse side of the media. The controller also operates another actuator to engage the media with the absorbent member of the applicator 45 after the application of the electromagnetic ink to remove the electromagnetic ink riding on the solid background areas. The electromagnetic ink in the negative image areas is not removed because it is absorbed into the media. The media then continues through the printer 500 for known processing of the media prior to the depositing of the media in an output tray.

While the imaging system above has been described as an inkjet printer, the principles of the method and system so described can be implemented in a xerographic printing system. In such a system, the raster image is adjusted before forming the charged image on the photoreceptor belt that includes the solid background area and negative image of the magnetic features. The non-electromagnetic toner is applied to the area in which the solid background area and negative image are located. Thus, the toner developer of a xerographic system that applies non-electromagnetic toner corresponds to the inkjet printheads described above that eject non-electromagnetic ink to form the solid background area and the negative image of the magnetic features. An electromagnetic ink applicator described above is configured to apply the electromagnetic ink to the solid background area and the negative image so the absorbent member can remove the electromagnetic ink from the solid background area, while leaving the electromagnetic ink in the negative image area.

While the ink applied to the negative image has been described as an electromagnetic ink useful for MICR printing, the principles of the method and system described in this document can be implemented with an ink having other electronic, mechanical, chemical, or optical properties. For example, the process and system can be used to apply conductive inks with the applicator to the negative image. "Conductive ink" means an ink that contains conductive materials, such as metals, which produce a conductive trace when dried or further processed. In this example, the negative image is formed with a non-conductive material, such as solid ink or toner. Besides simply drying the conductive ink, further processing of the conductive ink can include treatments of the media by laser sintering, flash fusing, electron beam processing, plasma processing, encapsulation, etching, or coating, for example. Other desirable electronic properties for patterned films produced by applying suitable inks to the negative image and post processing of the ink in the negative image could include patterns formed with inks having polarizing materials, semi-conductive materials having p or n type material, dielectric materials, reflective materials, or electroluminescent materials. Applying the inks with the electromagnetic, mechanical, chemical, or optical materials can be part of an assembly of other parts or layers to form larger devices, components, or three-dimensional structures. Other inks that can be applied to the negative image of the features include materials that are resistant to various chemicals or impart various degrees of hardness to the media.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A digital printer comprising:

an imaging member;

at least one marking material applicator configured to apply marking material onto a surface of the imaging member as the imaging member rotates past the at least one marking material applicator in a process direction;

an actuator operatively connected to a roller, the actuator being configured to move the roller into and out of engagement with the imaging member to form selectively a nip between the roller and the imaging member;

a media transport to move a media sheet into the nip formed between the imaging member and the roller to transfer the marking material from the surface of the imaging member to the media;

another actuator operatively connected to a member, the actuator operatively connected to the member being configured to move the member into engagement with the media;

another actuator operatively connected to an absorbent member, the actuator operatively connected to the absorbent member being configured to move the absorbent member into engagement with the media after the media has left the nip; and a controller operatively connected to the actuators and the at least one marking material applicator, the controller being configured to:

operate the at least one marking material applicator with reference to image data to apply the marking material to form on the surface of the imaging member a solid background area and a negative image of features to be formed with a liquid ink;

operate the actuator operatively connected to the roller to form the nip and enable media to pass through the nip to transfer the marking material from the surface of the imaging member to the media;

operate the actuator operatively connected to the member to apply the liquid ink to the solid background area and the negative image of features to be formed with the liquid ink; and operate the actuator operatively connected to the absorbent member to remove the liquid ink from the solid background area.

2. The digital printer of claim 1, the at least one marking material applicator being further configured to apply non-electromagnetic toner as the marking material to the image receiving surface to form the solid background area and the negative image of the features to be formed with the liquid ink.

3. The digital printer of claim 1, the at least one marking material applicator further comprising:

at least one printhead configured to eject non-electromagnetic ink onto the image receiving surface.

4. The digital printer of claim 3, the controller being further configured to:

operate the at least one printhead to eject non-electromagnetic ink that forms the solid background and the negative image with non-electromagnetic ink that contrasts highly with the liquid ink.

5. The digital printer of claim 3, the controller being further configured to:

operate the at least one printhead to eject clear non-electromagnetic ink to form the solid background and the negative image.

6. The digital printer of claim 1, the controller being further configured to:

operate the actuator operatively connected to the member to withdraw the member from the image receiving surface.

7. The printer of claim 1 wherein the liquid ink applied to the solid background area and the negative image being electromagnetic ink.

8. The printer of claim 1, the actuator operatively connected to the member further comprising:

a plurality of actuators;

a plurality of rollers, each roller in the plurality of rollers being connected to one of the actuators in the plurality of rollers in a one-to-one correspondence; and the controller being further configured to operate the plurality of actuators selectively to move the rollers in the plurality of rollers independently of one another to engage the solid background area and the features to be formed with the liquid ink.

* * * * *